United States Patent [19]

Gross et al.

[11] 4,311,943

[45] Jan. 19, 1982

[54] FLUORESCENT LAMP WITH ARC SPREADING WITH RECOMBINATION STRUCTURES

[75] Inventors: Leo Gross, Bayside; S. Merrill Skeist, Glenhead, both of N.Y.

[73] Assignee: Spellman High Voltage Electronics Corp., Plainview, N.Y.

[21] Appl. No.: 93,052

[22] Filed: Nov. 13, 1979

[51] Int. Cl.[3] ..... H01J 7/44; H01J 17/34; H01J 23/16; H01K 1/62

[52] U.S. Cl. ..... 315/70; 313/161; 315/41; 315/57; 315/62

[58] Field of Search ..... 313/161; 315/41, 42, 315/62, 70, 54, 57

[56] References Cited

U.S. PATENT DOCUMENTS

| | | | |
|---|---|---|---|
| 2,030,401 | 2/1936 | Ruff | 315/62 X |
| 2,087,753 | 7/1937 | Davis | 315/62 |
| 2,298,581 | 10/1942 | Abadie | 315/62 |
| 2,301,670 | 11/1942 | Abadie | 315/62 X |
| 2,411,510 | 11/1946 | Abadie | 313/161X |
| 2,780,748 | 2/1957 | Williams et al. | 315/41 X |
| 3,079,521 | 2/1963 | Clark | 313/161 |
| 3,883,763 | 5/1975 | Kearney | 313/161 |

*Primary Examiner*—Saxfield Chatmon, Jr.
*Attorney, Agent, or Firm*—Kenneth S. Goldfarb

[57] ABSTRACT

An arc discharge device such as a fluorescent lamp comprising an outer envelope having an inner phosphor coating. An arc spreading assembly is disposed in said envelope. There is provided a recombination structure in the form of fine glass or quartz fibers disposed in the envelope.

2 Claims, 2 Drawing Figures

FIG. 1
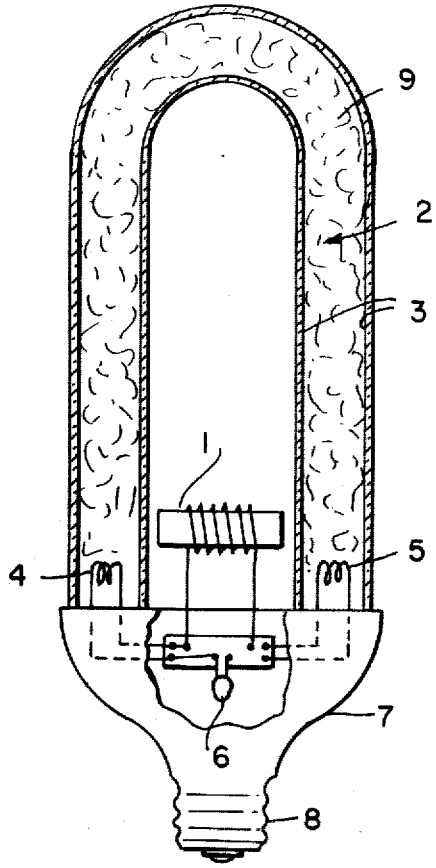
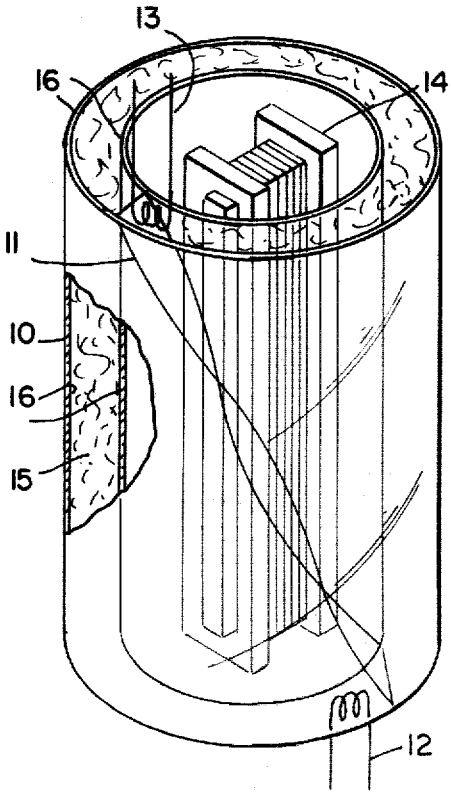
FIG. 2

FLUORESCENT LAMP WITH ARC SPREADING WITH RECOMBINATION STRUCTURES

REFERENCE TO RELATED APPLICATIONS

This application is copending with the applications Ser. No. 834,651, filed Sept. 21,1977, and application Ser. No. 45,589 filed June 4, 1979.

BACKGROUND OF THE INVENTION

1. Field of the Invention

The present invention relates to a fluorescent lamp provided with increased luminosity achieved by applying a magnetic field to spread the arc throughout the enlarged volume of the lamp envelope.

2. Description of the Prior Art

The present invention is an advance over the initial description of the technique of arc spreading used in conjunction with fluorescent lamps in the co-pending applications Ser. Nos. 834,651 and 45,589, wherein arc spreading enable the fabrication of energy saving screw-in fluorescent lamps as replacements for incandescent lamps which are of inherently low efficacy in lumens per watt. Arc spreading lamps are not restricted to circular cross sections because the magnetic field of the arc spreading coil forces the arc to fill the entire volume of the lamp.

In October, 1976, Hasker described a new concept for fluorescent lamps in the Journal of the Illuminating Engineering Society wherein fine glass wool or quartz fibers were placed in the path of the arc discharge. The fibers provided a recombination structure for the ions and electrons increasing the voltage drop per unit length and increasing the lumen output per unit length enabling the construction of shorter lamps. The lamps described by Hasker are cylindrical with circular cross-sections bent into a U tube for a more compact assemblage.

SUMMARY OF THE INVENTION

The present invention combines the advantages of a recombination structure of fine fibers interposed in the arc path with an arc spreading coil to spread the arc throughout the volume of the fluorescent lamp. An arc spreading lamp has greater luminous efficacy than a lamp of conventional circular cross section, with or without a recombination fiber structure.

BRIEF DESCRIPTION OF THE DRAWING

FIG. 1 illustrates a side elevational view with parts in section of one of many possible configurations of the screw-in fluorescent lamp, a U tube configuration; and FIG. 2 is a perspective view of another configuration in the embodiment of a cylindrical shaped lamp.

DETAILED DESCRIPTION OF THE INVENTION

The arc spreading coil 1 is placed between the arms of the U-shaped lamp 3 (FIG. 1). The arc discharge is established in the volume of the lamp 2 which energizes the phosphor on the inner surfaces of the lamp 3. The arc discharge flows between the filaments (electrodes) 4 and 5. The current in the arc is limited by a ballast which may be the arc spreading coil 1. Additional circuitry such as the starter 6, etc. is housed under the bezel 7 and inside the screw plug 8 of the lamp. The cross section of the U-shaped envelope is elliptical or oval with the major diameter several times larger than the minor diameter.

The interior volume of the lamp 3 is threaded with an insubstantial gossamer, fine fibers 9 of glass or quartz which serve as recombination structures. When the magnetic field arc spreading coil is not energized, the arc discharge flows between the filaments in a path through the center of the lamp 3 and the arc discharge cross section is roughly circular. With the arc spreading coil 1 energized and producing a magnetic field, the arc discharge occupies the full volume 2 of the lamp 3, thereby increasing light output of the lamp 3. The arc spreading coil 1 is located just above the filaments 4, 5 to spread the arc discharge to flow through all of the lamp envelope. The arc spreading coil 1 serves as all or part of the ballast of the fluorescent lamp 3.

A compact fluorescent lamp can be fabricated in any of a number of designs in a cylindrical or globular shape. The lamp depicted in FIG. 2 is one such configuration chosen for illustration among many other possible designs. The lamp is in effect a double cylinder 10 with a partition 11, and filaments, 12, 13 containing an arc spreading coil/ballast 14 in the hollow center. Fine glass or quartz fibers 15 are distributed throughout the lamp volume to form recombination surfaces for the arc discharge. The inner surfaces of the lamp are phosphored at 16. Light output is increased by encasing the arc spreading coil in a reflective container. The magnetic field of the arc spreading coil in concert with the alternating current, diverges outward from the pole pieces, expanding and contracting, causing the electrons generated by the arc discharge to diffuse in a direction perpendicular to both the magnetic and electric fields. By the choice of coil design, the arc current will spread, as its component electrons spiral about the magnetic lines of force at the cyclotron frequency, throughout the entire volume of the lamp. Selection of the proper number of ampere turns in the arc spreading coil cause the arc to fill the entire volume of the lamp envelope. The voltage across the arc is relatively constant; i.e., approximately the same as when magnetic field is present, the voltage gradient is constant and is based upon the parameters of lamp construction, rare gas pressure, recombination structures, etc. The current through the arc is held relatively constant by the external circuitry of the lamp. Little change in total lamp wattage is noted when the arc spreading coil is energized.

In the conventional fluorescent lamp, the arc has its greatest current density at the center of an arc of approximately circular cross section and this current density diminishes rapidly outward. The current in the center of the arc contributes less toward energizing the phosphor and producing light since radiation produced in that region may encounter ground state mercury atoms and be absorbed before the UV light quanta reach the phosphor. Where an arc spreading coil is energized, the current density pattern is diffused as the arc spreads. The total current remains unchanged while the local current density is more uniform throughout the lamp volume, bringing electrons closer to the lamp wall, decreasing losses due to readiative absorption. By this means, an arc spreading coil increases light output as measured in lumens/watt, thus increases lamp efficacy. Arc spreading frees the lamp designer from the constraint of a long, tubular, cylindrical envelope, which maintain the center of the arc at the optimum distance from the phosphor, approximately 19 mm ($\frac{3}{4}$") in a diameter of 38 mm (1.5"). With magnetic field arc spreading, the space between partitions in the lamp can be greater than 38 mm (1.5") while maintaining effective light output from the arc discharge with a phosphor uniformly and evenly emitting light from all lamp surfaces.

The fine glass or quartz fibers in the volume of the fluorescent lamp increases the luminous flux by increasing power density without appreciably effecting efficacy. The fine fibers act as recombination structures for electrons and ions in the arc which increases the voltage drop per unit length. Thus more power is expended for a given length of lamp, and more of this energy is converted into visible light resulting in a brighter shorter lamp.

When both principles, arc spreading and recombination structures are combined in one lamp, the effects are synergistic. The lamp is shorter, broader and brighter than lamps utilizing each principle alone and, of course, unexpectedly greatly brighter than a conventional fluorescent lamp of equal arc length.

What is claimed is:

1. An arc discharge device such as a fluorescent lamp comprising an outer envelope, said envelope containing arc spreading means including two electrodes to form the arc discharge, and a luminescent phosphor coating all interior walls of said envelope, said arc spreading means further including ballast and circuitry means in said envelope, a screw-in base secured to said envelope and electrically operatively connected to said ballast and circuitry means and said electrodes, recombination structure means in said envelope for electrons and ions to convert more energy into more visible light, said recombination structure means being an insubstantial gossamer of fine fibers of glass or quartz, said envelope being U-shaped and having two legs and an interconnecting portion, said screw-in base being secured to said interconnecting portion, said arc spreading means being disposed between said two legs, said U-shaped envelope having a flattened elliptical, non-circular cross-section.

2. An arc discharge device according to claim 1, including a partition in said envelope.

* * * * *